US006217151B1

(12) United States Patent
Young

(10) Patent No.: US 6,217,151 B1
(45) **Date of Patent: *Apr. 17, 2001**

(54) CONTROLLING AIP PRINT UNIFORMITY BY ADJUSTING ROW ELECTRODE AREA AND SHAPE

(75) Inventor: Michael Yu-Tak Young, Cupertino, CA (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/099,748

(22) Filed: Jun. 18, 1998

(51) Int. Cl.[7] ..... B41J 2/135
(52) U.S. Cl. ..... 347/46
(58) Field of Search ..... 347/46, 68; 310/334, 310/335; 427/600

(56) References Cited

U.S. PATENT DOCUMENTS

| | | | | |
|---|---|---|---|---|
| 4,308,547 | | 12/1981 | Lovelady et al. . | |
| 4,460,841 | * | 7/1984 | Smith et al. | 310/334 |
| 4,520,374 | | 5/1985 | Koto . | |
| 4,678,889 | | 7/1987 | Yamanaka . | |
| 4,697,195 | | 9/1987 | Quate et al. . | |
| 4,719,480 | | 1/1988 | Elrod et al. . | |
| 4,772,774 | | 9/1988 | Legeune et al. . | |
| 4,959,674 | | 9/1990 | Khri-Yakub et al. . | |
| 5,028,937 | | 7/1991 | Khuri-Yakub et al. . | |
| 5,096,850 | | 3/1992 | Lippitt, III . | |
| 5,284,794 | | 2/1994 | Isobe et al. . | |
| 5,345,361 | | 9/1994 | Billotte et al. . | |
| 5,374,590 | | 12/1994 | Batorf et al. . | |
| 5,389,956 | | 2/1995 | Hadimioglu et al. . | |
| 5,530,465 | | 6/1996 | Haseqawa et al. . | |
| 5,565,113 | | 10/1996 | Hadimioglu et al. . | |
| 5,569,398 | | 10/1996 | Sun et al. . | |

FOREIGN PATENT DOCUMENTS

| | | |
|---|---|---|
| 0 692 383 A2 | 1/1996 | (EP) . |
| 0 835 756 A2 | 4/1998 | (EP) . |
| 61-118261 | 5/1986 | (JP) . |
| 07246703 | 9/1995 | (JP) . |

* cited by examiner

*Primary Examiner*—John Barlow
*Assistant Examiner*—Michael S. Brooke
(74) *Attorney, Agent, or Firm*—Fay, Sharpe, Fagan, Minnich & McKee, LLP

(57) ABSTRACT

An acoustic ink print head includes an array of individual emitters. Each of the emitters have a corresponding transducer with a lower electrode, a separate layer of a piezo-electric material located on the lower electrode, and a separate upper electrode provided on the upper surface of the piezo-electric layer. The upper and lower electrodes are connected to a source of conventionally modulated RF power. A dielectric layer is deposited on top of this structure and lenses are etched into the top of the dielectric layer. The lenses focus energy generated by the transducer to a region of the upper surface of a body of liquid located above the transducer. The lenses concentrate sound waves from the transducers thereby disturbing the surface and causing droplets to be emitted. The print head is formed as an array of individual emitters. The upper electrodes of the individual emitter array have varying surface areas dependent upon their location within a row of electrodes and their output efficiencies. The upper electrodes are altered in order to provide a uniform end-to-end print output.

20 Claims, 10 Drawing Sheets

CONTROLLING AIP PRINT UNIFORMITY BY ADJUSTING ROW ELECTRODE AREA AND SHAPE

BACKGROUND OF THE INVENTION

The present invention relates generally to acoustic ink printing (AIP) and more particularly to improved print head transducers, for increasing printing uniformity.

AIP is a method for transferring ink directly to a recording medium having several advantages over other direct printing methodologies. One important advantage is, that it does not need nozzles and ejection orifices that have caused many of the reliability (e.g., clogging) and picture element (i.e., "pixel") placement accuracy problems which conventional drop-on-demand and continuous-stream ink jet printers have experienced. Since AIP avoids the clogging and manufacturing problems associated with drop-on-demand, nozzle-based ink jet printing, it represents a promising direct marking technology. While more detailed descriptions of the AIP process can be found in U.S. Pat. Nos. 4,308,547, 4,697,195, and 5,028,937, essentially, bursts of focused acoustic energy emit droplets from the free surface of a liquid onto a recording medium. By controlling the emitting process as the recording medium moves relative to droplet emission sites, a predetermined image is formed.

To be competitive with other printer types, acoustic ink printers must produce high quality images at low cost. To meet such requirements it is advantageous to fabricate print heads with a large number of individual droplet emitters using techniques similar to those used in semiconductor fabrication. While specific AIP implementations may vary, and while additional components may be used, each droplet emitter will include an ultrasonic transducer (attached to one surface of a body), a varactor for switching the droplet emitter on and off, an acoustic lens (at the opposite side of the body), and a cavity holding ink such that the ink's free surface is near the acoustic focal area of the acoustic lens. The individual droplet emitter is possible by selection of its associated row and column.

As may be appreciated, acoustic ink printing is subject to a number of manufacturing variables, including transducer piezo-electric material thickness, stress and composition variation; transducer loading effects due to wire bond attachment to the top electrode and top electrode thickness; ink channel gap control impacting acoustic wave focal point variations; aperture hole variations causing the improper pinning of the ink meniscus; RF distribution non-uniformity along the row electrodes, electromagnetic reflections on the transmission lines, variations in acoustic coupling efficiencies, and variations in the components associated with each transducer. Because of manufacturing constraints, these variables cannot be sufficiently controlled. The variables can result in non-uniform print profiles such as print head end-to-end non-uniformity printing. One type of non-uniform printing is a fixed pattern "frown" effect, wherein the intensity of ink in a middle portion of a print area is greater than at the outer edges of the print area.

A typical "frown" effect is illustrated by test print pattern A of FIG. 1. The "frown" results from non-uniform droplets, i.e., droplets that vary in size, emission velocity, emission frequency and/or other characteristics. In addition to the "frown" effect, other non-uniform printing which can occur include a "smile" effect, which exists when there is non-uniformity in printing in a direction orthogonal to the length of the print head. Non-uniform droplet ejection velocity can produce misaligned droplets. Non-uniform droplets may degrade the final image so much that the image becomes unacceptable. Therefore, a need exists to improve droplet uniformity in acoustic ink printing, for the "frown" and "smile" effects, as well as other non-uniformity patterns.

SUMMARY OF THE INVENTION

In accordance with the present invention, described are techniques and devices for improving end-to-end, top-to-bottom, and other types of AIP print uniformity.

In accordance with an aspect of the present invention, there is provided an improved print head having transducers with upper electrodes of differing areas, and a method for producing the transducers.

An acoustic ink printer print head in accordance with the present invention includes an array of transducers reshaped in accordance with area ratios which allow for end-to-end and top-to-bottom uniform printing. An upper electrode layer of the transducer has selected areas removed such that at least some of the transducers have different area ratios than others in the same row and/or column layer.

In accordance with another aspect of the present invention, the upper electrodes having at least some of their area removed are in the form of one of a "donut" and "dot " configuration.

With attention to another aspect of the present invention, in addition to the normal print head process and assembly, after an initial print test and/or threshold of ejection measurements from end-to-end and/or top-to-bottom of the print head are undertaken and determined, a transducer threshold of ejection end-to-end, top-to-bottom or other profile is captured. A first step of correction in one embodiment uses laser trimming to detune transducers near the center columns, such transducers having been determined to be more efficient than those not as close to the center columns. By the selective laser trimming of a top electrode area, selected ones of the transducer's print efficiency are reduced.

Subsequent print testing, after laser trimming, is used to confirm print uniformity improvement. When the transducer detuning profile is established across representative print heads, the second step is to encode the area and shape changes that are necessary for a first order correction. This information is encoded into an electrode process mask. A third step of correction is further refining the first step after incorporation of the first order correction in the row and/or column electrode mask.

BRIEF DESCRIPTION OF THE DRAWINGS

Further objects and advantages of this invention will become apparent when the following detailed description is read in conjunction with the attached drawings, in which.

DETAILED DESCRIPTION OF THE PREFERRED EMBODIMENT

While the invention is described in some detail herein below with reference to certain illustrated embodiments, it is to be understood that there is no intent to limit it to those embodiments. On the contrary, the aim is to cover all modifications, alternatives, and equivalents falling within the spirit and scope of the invention as defined by the appended claims. While the following discussion focuses on improving end-to-end print profiles, to eliminate the "frown" effect, the concepts detailed herein may also be applied to improvement of top-to-bottom print patterns, i.e., a "smile" effect, as well as other print patterns.

Figure 2:
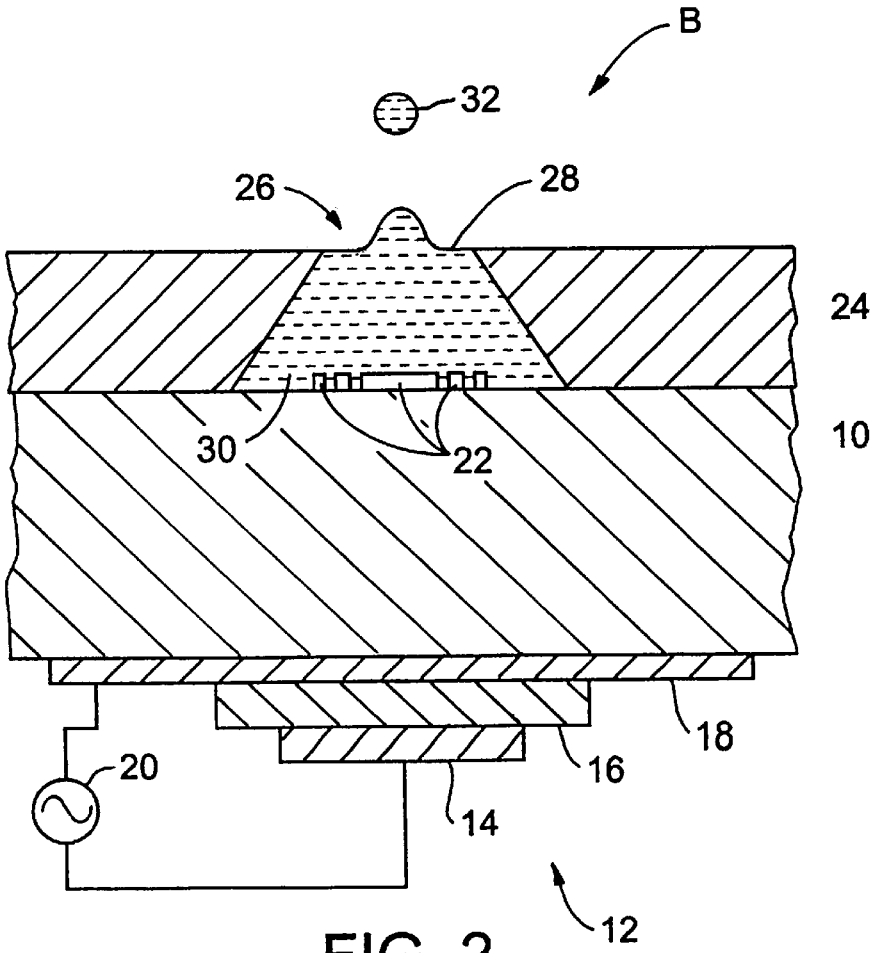
FIG. 2 is a cross-sectional view of a print head for acoustic ink printing.

Turning attention now to the drawings, and more particularly to FIG. 2, illustrated is a partial side view of an acoustic ink print head, and more particularly, an individual acoustic ink emitter B of such a print head. Emitter B includes a substrate 10, for example a glass substrate. Located on a bottom surface of substrate 10 is a transducer 12. More particularly, a thin Ti-W layer 18 is deposited to serve as a lower electrode for transducer 12. A separate layer of piezo-electric material 16 such as ZnO is grown on layer 18. A separate upper electrode 14, for example a thin layer (e.g. 1$\mu$m) of aluminum or a quarter wave thickness gold, is provided on the upper surface of the piezo-electric layer 16. Upper electrode 14 may have a diameter, for example of 340 $\mu$m. The upper and lower electrodes are connected to a source 20 of conventionally modulated RF power.

Acoustic lens 22, such as a Fresnel or spherical lens is etched in the top of the substrate 10 above transducer 12. Located on top of substrate 10 is top plate 24, defining an aperture 26. The above-described structure may be fabricated in accordance with conventional techniques.

In operation, sound energy from transducer 12 is directed upwardly toward lens 22, and the lens focuses the energy to the region of upper surface 28 of a body of liquid such as ink 30 above transducer 12. The lens 22 concentrates sound waves from transducer 12 thereby disturbing surface 28 causing droplet 32 to be emitted.

Figure 3:
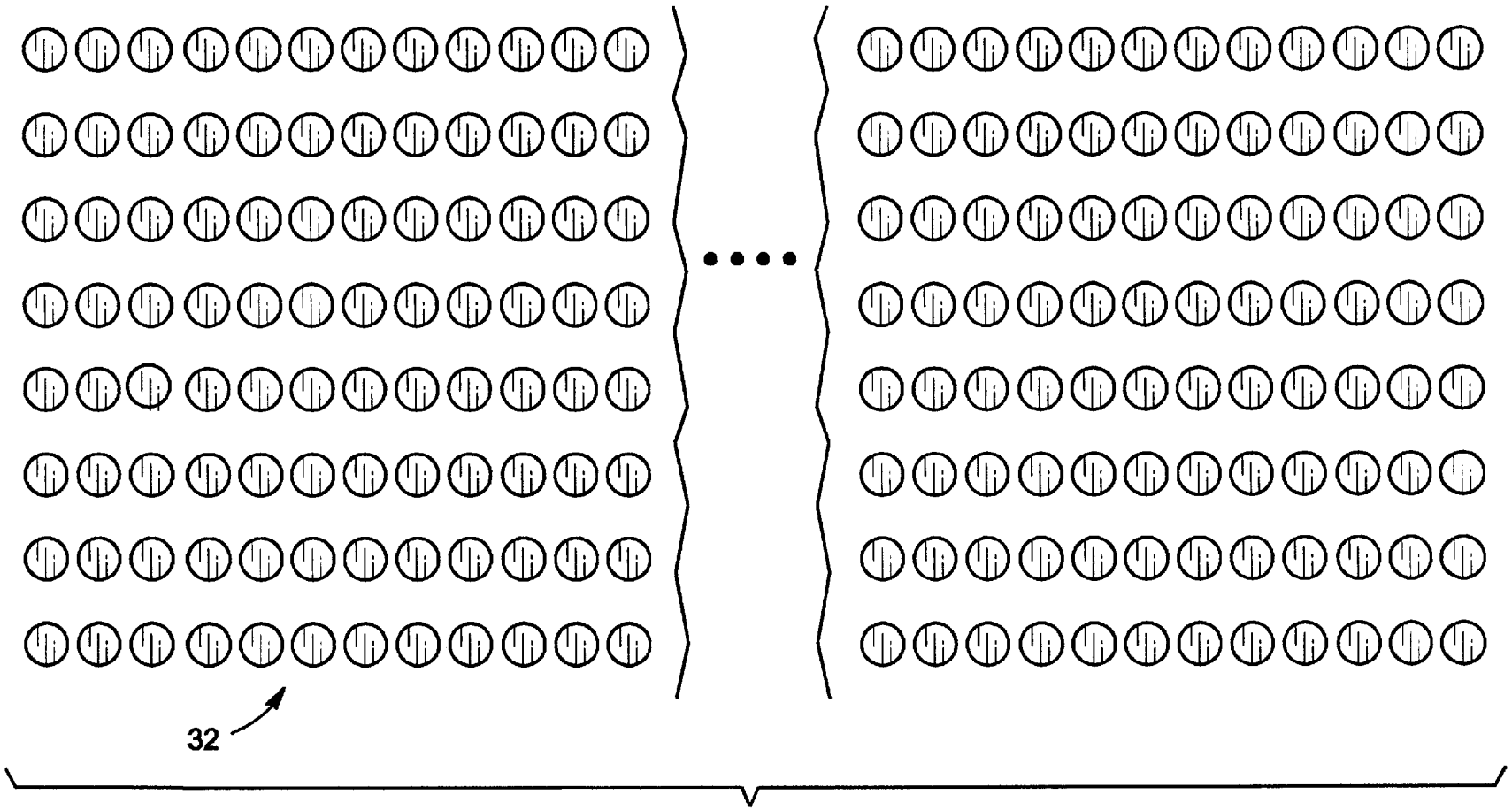
FIG. 3 is a top view of an array of upper electrodes.

An individual acoustic droplet emitter, such as described in FIG. 2 is usually fabricated as part of an array of acoustic droplet emitters. FIG. 3 illustrates a top-down schematic depiction of an array 32 of individual upper electrodes 14 of an array of transducers such as transducer 12. A typical AIP print head may have 8 rows and 128 columns of individual droplet emitters. In typical arrangements each emitter will have a corresponding transducer 12, which in turn will have a corresponding upper electrode 14. For convenience, FIG. 3 shows a partial representation of array 32. It is also to be noted that while the foregoing numbers are typical representations, AIP print heads with greater or fewer emitters may also be configured.

The array of emitters corresponding to upper electrodes of array 32 are selectively energized in order to produce an appropriate pattern onto a sheet of paper or other destination document. This is accomplished by a switching pattern such as further described in the patent to Hadimioglu et al., U.S. Pat. No. 5,389,956 hereby incorporated by reference.

Figure 4:
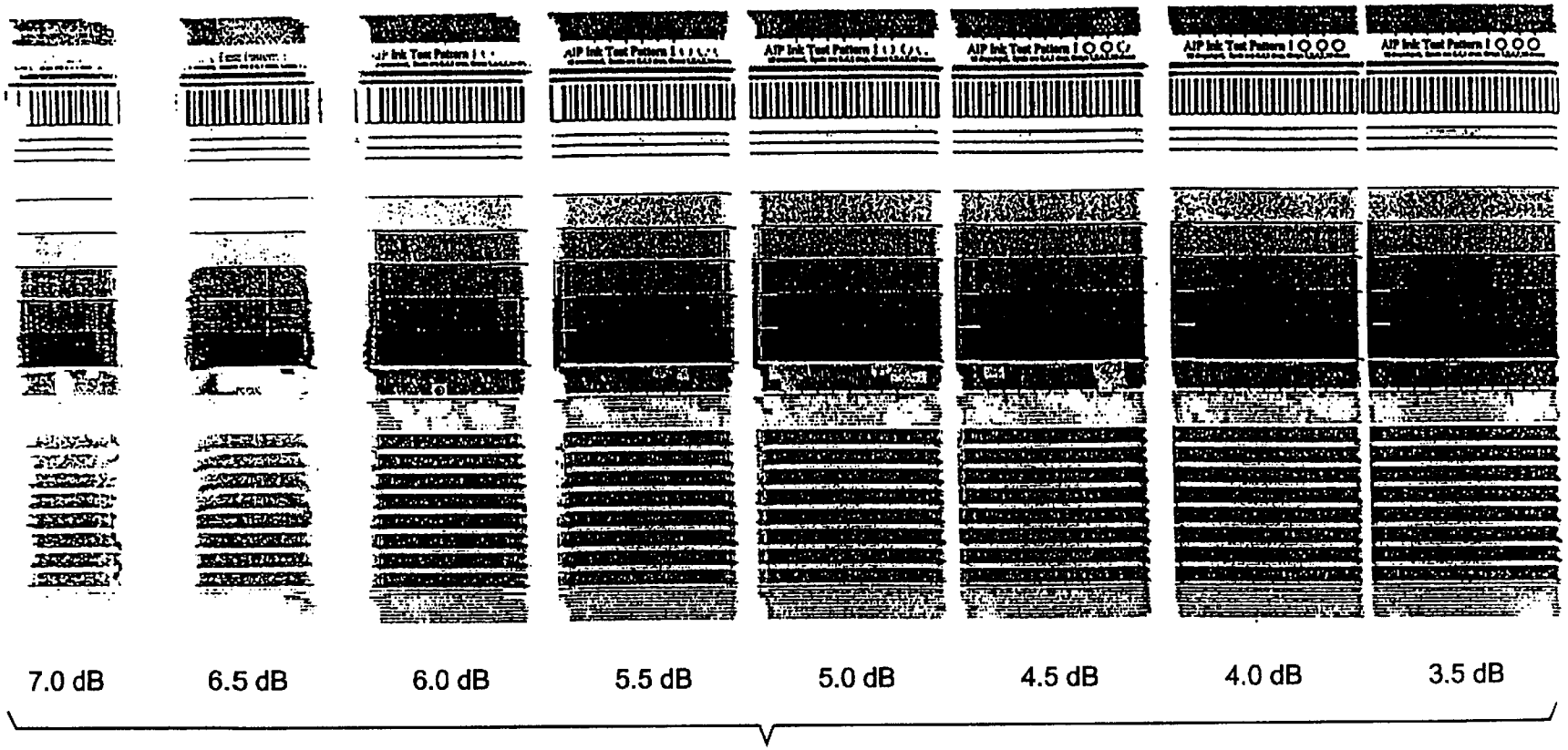
FIG. 4 shows a variety of test-print patterns illustrating end-to-end non-uniform printing.

FIG. 4 is a series of print test patterns showing print head capability as varying levels of energy are supplied to a print head. In particular, illustrated is a range of power level outputs from 7.0 dB to 3.5 dB, and where Vco offset =2.65V (corresponding to a RF center frequency of 165 MHZ).

When 7.0dB of power is supplied to a print head constructed according to the previous teachings, i.e. using the upper electrode array such as shown in FIG. 3, a small amount of ink is transferred to the destination document. As the dB level is decreased, thereby providing more power to the print head, it can be seen that more ink is applied to the destination document.

The print test patterns shown in FIG. 4 illustrate the concept of the "frown" effect previously discussed. However, when the print test patterns were reviewed, the 6.0 dB print pattern providing a middle portion intensity was considered to be of a desirable intensity value. However, the edges at the 6.0 dB test pattern showed a lack of ink and thereby insufficient intensity. In reviewing the 3.5 dB test pattern it was determined the center portion had an over saturation of ink, however the edges were of an appropriate level.

It was therefore determined from this investigation, that in arrays having a plurality of emitters, i.e. such as an array which has 8 rows, each with 128 emitters, the switching considerations as well as the manufacturing process tend to cause the center emitters of such an array to be more efficient than the emitters located near the end of a row. Therefore, the inventors undertook investigations to provide a more uniform operation of the emitters from end-to-end of the print head.

It was found that altering the area of individual upper electrodes 18 at selected locations within array 32 provided improvements in the end-to-end uniform printing capabilities of an AIP print head.

Figure 5:
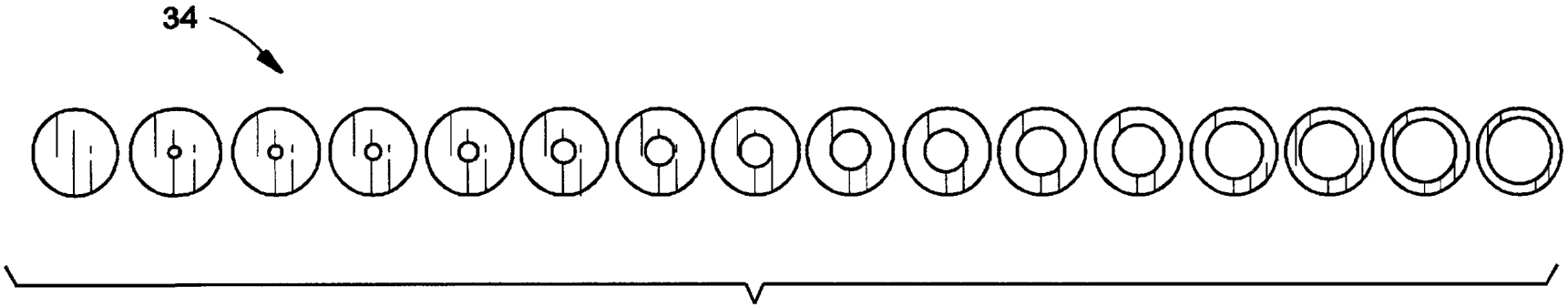
FIG. 5 depicts a subset of "donut" shaped top electrodes of a transducer according to the present invention.
Figure 6:
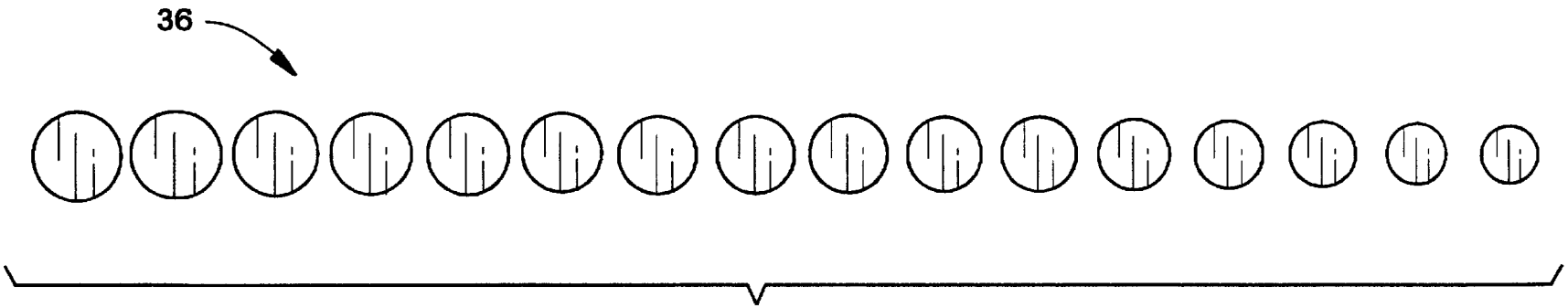
FIG. 6 illustrates "dot" shaped upper electrodes of a transducer according to the teachings of the present invention.

The detuning of the individual emitters is accomplished by the removal of portions of selected upper electrodes. The act of detuning, makes the detuned emitter, whose upper electrode has been altered, less efficient. Thus, emitters located near the center columns of a print head array would require a higher level of detuning than emitters located near the edges. By detuning an appropriate amount and in an appropriate pattern, uniform printing is achieved. FIGS. 5 and 6 illustrate upper electrodes 34, 36 which have had portions removed. FIG. 5 shows a row of 16 upper electrodes 34 having varying amounts of an interior portion removed, thereby maintaining the outer periphery of upper electrodes 34. This removal creates a "donut" shape. The more area which is removed, the greater the detuning. As an opposite arrangement from FIG. 5, FIG. 6 illustrates outer portions of electrodes 36 removed, forming "dot" electrodes. Similar to FIG. 5 the greater the area removed, the larger the detuning effect. FIGS. 5 and 6 disclose upper electrodes detuned from an area ratio of 1.0 (no area removed) to 0.45 (where 55% of the area is removed). It is to be appreciated the area percentages shown to be removed can be refined to a greater degree, and that when incorporated into a print head the specific pattern will be dependent upon the characteristics of the print head.

Figure 7A:
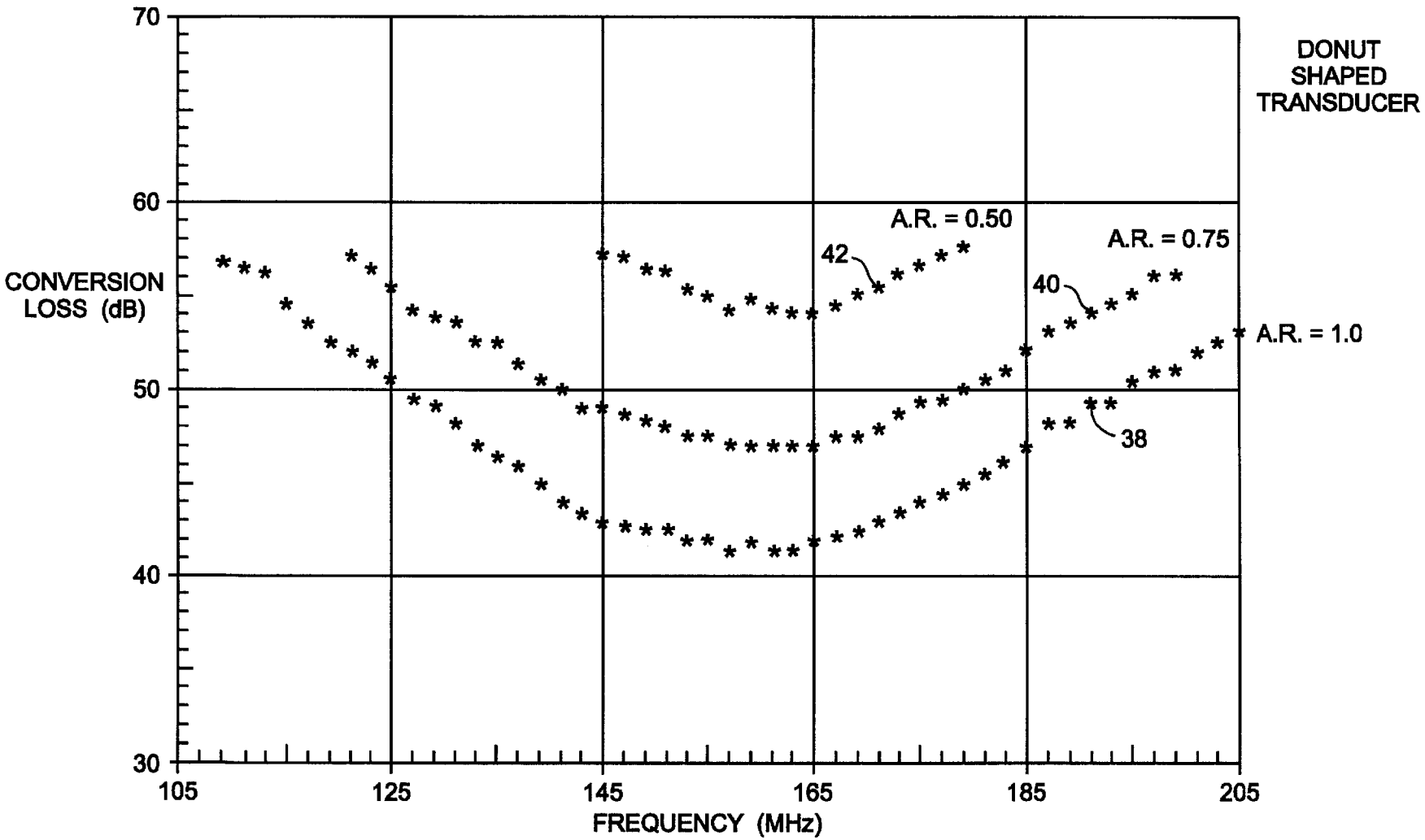
FIGS. 7A–7B represent conversion losses of "donut" and "dot" upper electrodes having varying area ratios.
Figure 7B:
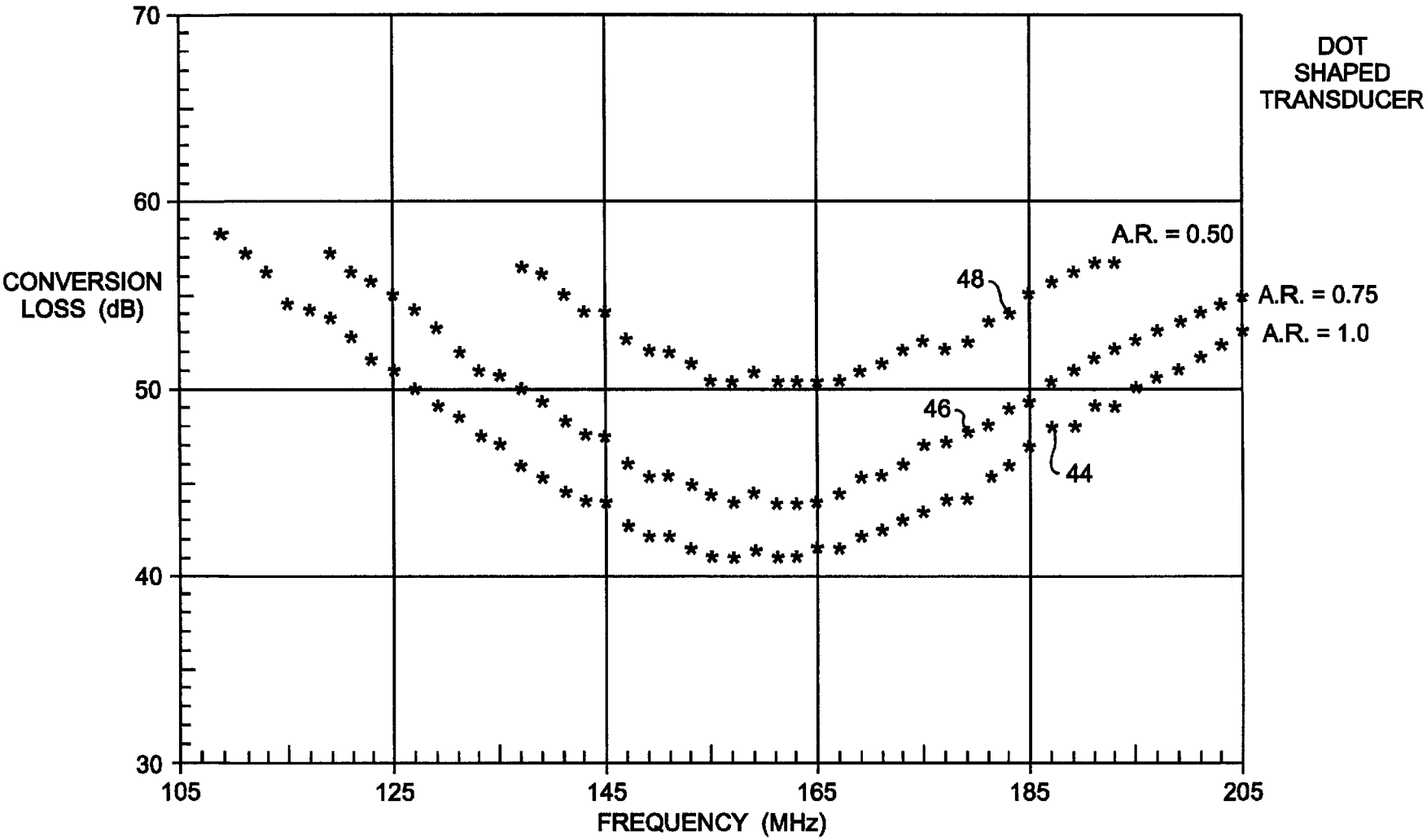
Figure 7C:
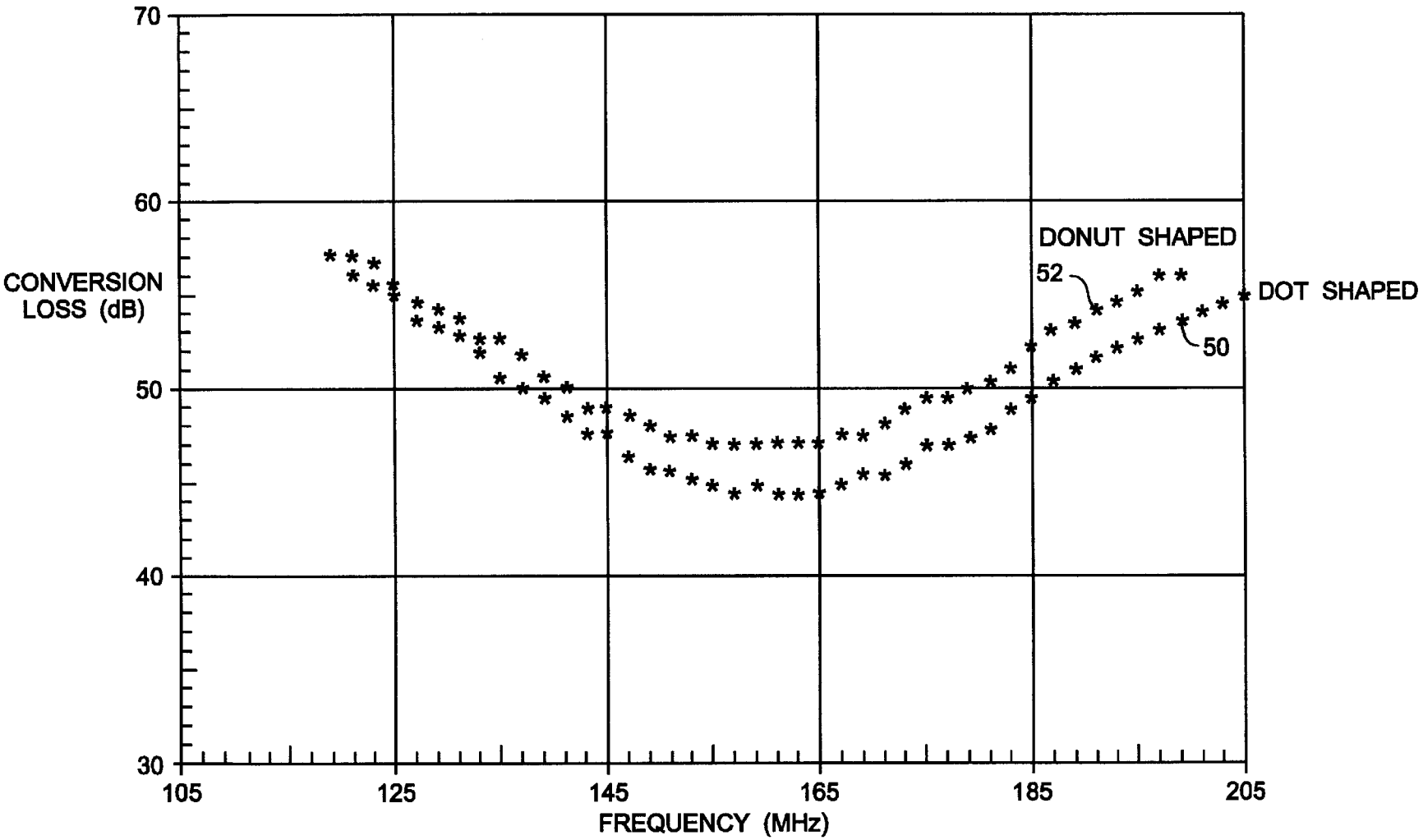
FIG. 7C compares a "donut" versus "dot" upper electrode at an area ratio of 0.75.

The foregoing effects of detuning are illustrated in FIGS. 7A–7C. FIG. 7A plots the effectiveness of "donut" shaped transducers, i.e. those with such an upper electrode, having varying area ratios. The graph plots conversion loss in decibels (db)versus frequency in megahertz. At emission frequency of approximately 165 megahertz, for a "donut" shaped transducer having an area ratio of 1.0 (1.0 being equal to no area being removed) 38, the conversion loss in decibels is 41 dB. However, for a "donut" shaped transducer having an area ratio of 0.75 (this means 25% of its area has been removed) 40, the conversion loss is approximately 48 dB. Lastly, it was found that a "donut" shaped transducer having an area ratio of 0.50 (i.e. half of its area has been removed) 42, suffers a conversion loss of 55 dB at the center frequency. The "donut" shaped transducer with a conversion loss of 55 dB is less power efficient than the transducer with 48 dB. In turn, the transducer with 48 dB is less power efficient than the transducer with 41 dB.

Normally it is desirable to fabricate transducers to have a low conversion loss (in dB) and have it be as power efficient as possible. However, for detuning transducers for print uniformity as illustrated here, making the transducers less power efficient is desirable.

FIG. 7B provides similar results for "dot" shaped transducers. Specifically, the efficiency from a fully formed transducer (i.e. with an area ratio of 1.0) 44 has less conversion loss and therefore is operating at a greater efficiency, 46, than the "dot" shaped transducers having an area ratio of 0.75 and 0.50, 48, respectively. Similarly, the "dot" shaped transducer with an area ratio of 0.75 operates at a higher efficiency than the "dot" transducer having an area ratio of 0.50. FIG. 7C confirms the similar operating characteristics of a "dot" 50 versus "donut" 52 transducer, both with an area ratio of 0.75. The "donut" shaped transducer is shown to be slightly more effective in detuning the transducer than the "dot" shaped transducer.

The foregoing discussion in connection with FIGS. 7A–7C illustrates that the operational characteristics of the emitters are dependent upon the area of the upper electrodes.

Figure 1:
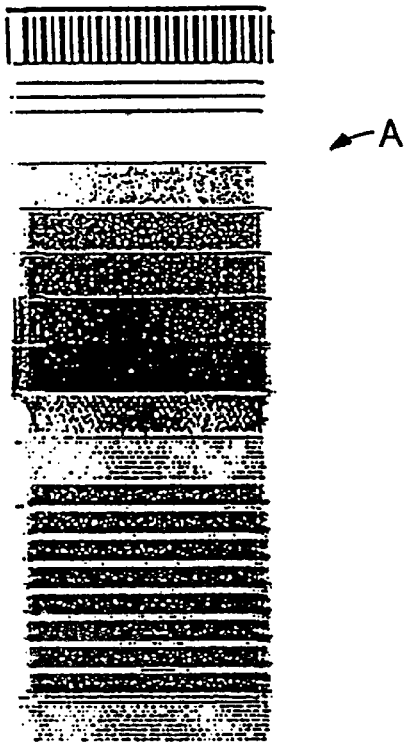
FIG. 1 is an illustration of the end-to-end frown effect.
Figure 8A:
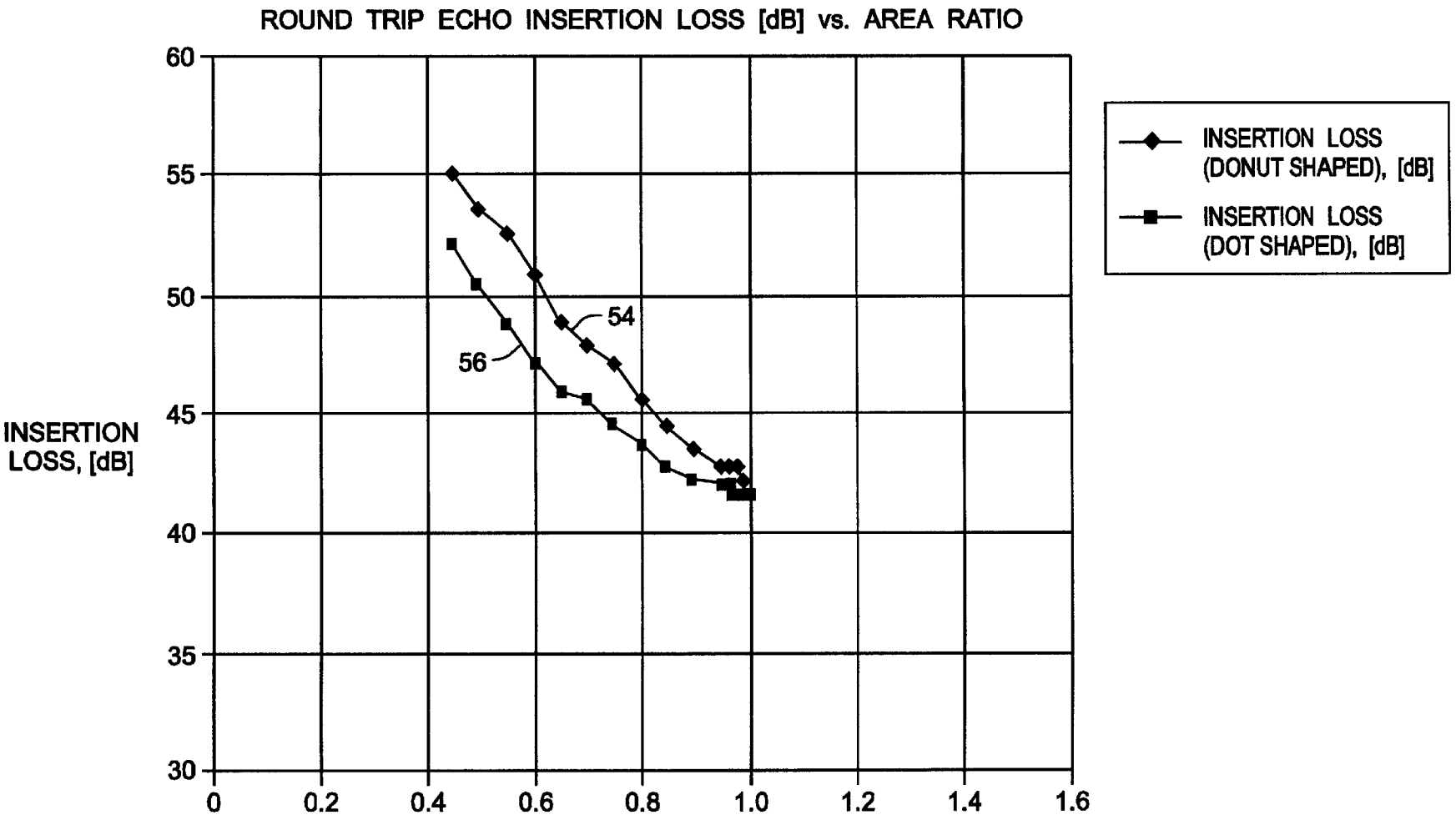
FIG. 8A is a graphical representation of round-trip echo insertion loss versus area ratio for a "donut" and "dot" upper electrode.

With the above understanding, a round-trip echo insertion loss versus area ratio study was undertaken. In this study an ultrasonic pulse was sent through devices of various area ratios for "donut" and "dot" configurations, then the reflection that came out the back side of the substrate of the device were recorded. The results were monitored by an oscilloscope and then plotted. The foregoing is a round-trip detection since the sound will go down and back up again during the transmission. The insertion losses are based on an ultrasonic pulse of a frequency of approximately 165 megahertz (i.e. the center frequency of an emitter such as described in FIG. 1). FIG. 8A verifies the insertion loss of the "adonut" shaped transducer 54 and the insertion loss of the "dot" shaped transducer 56 rise at a significant slope as the area ratio is decreased.

Figure 8B:
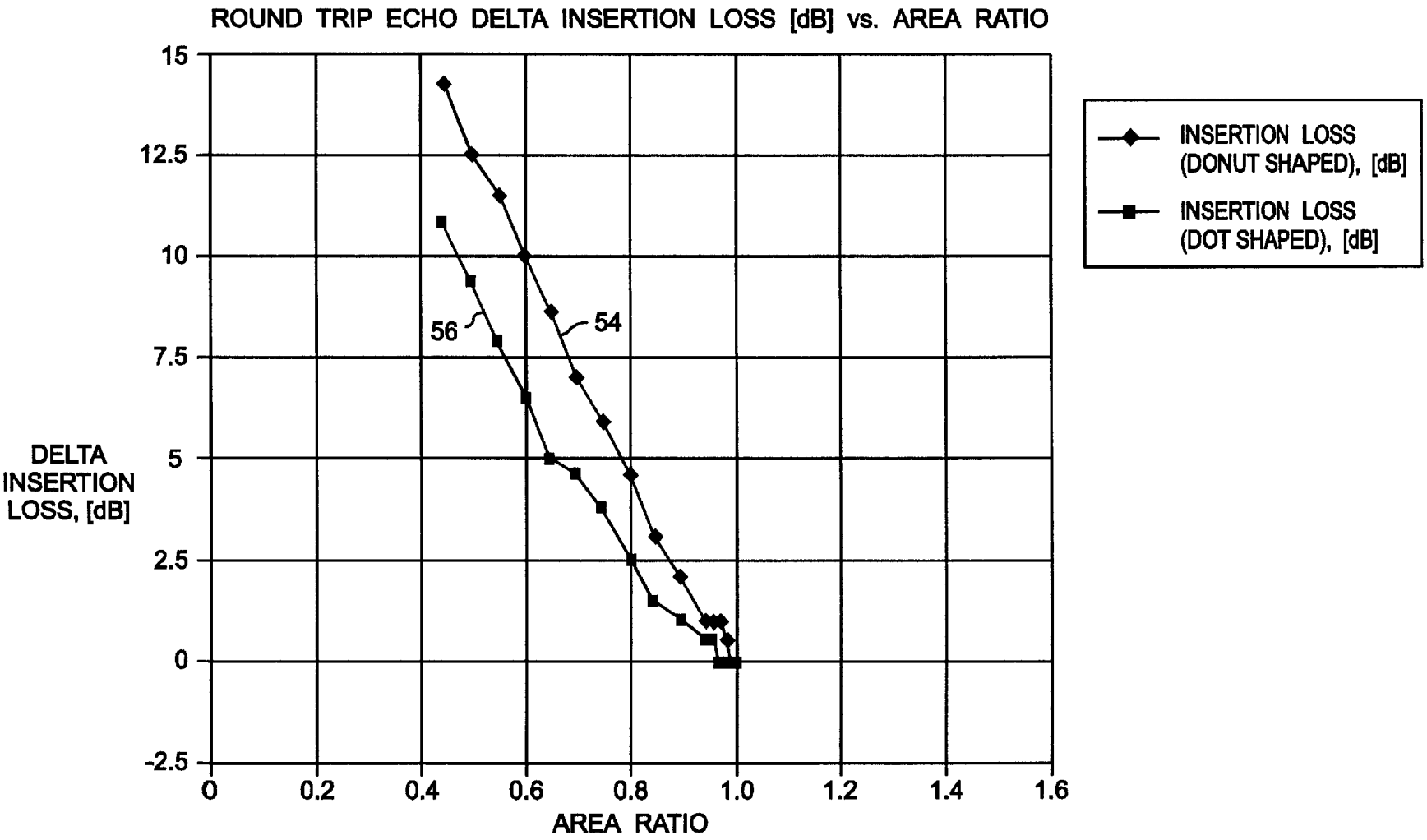
FIG. 8B is a normalized round-trip echo insertion loss versus area ratio graphical representation for a "donut" and a "dot" upper electrode.
Figure 8C:
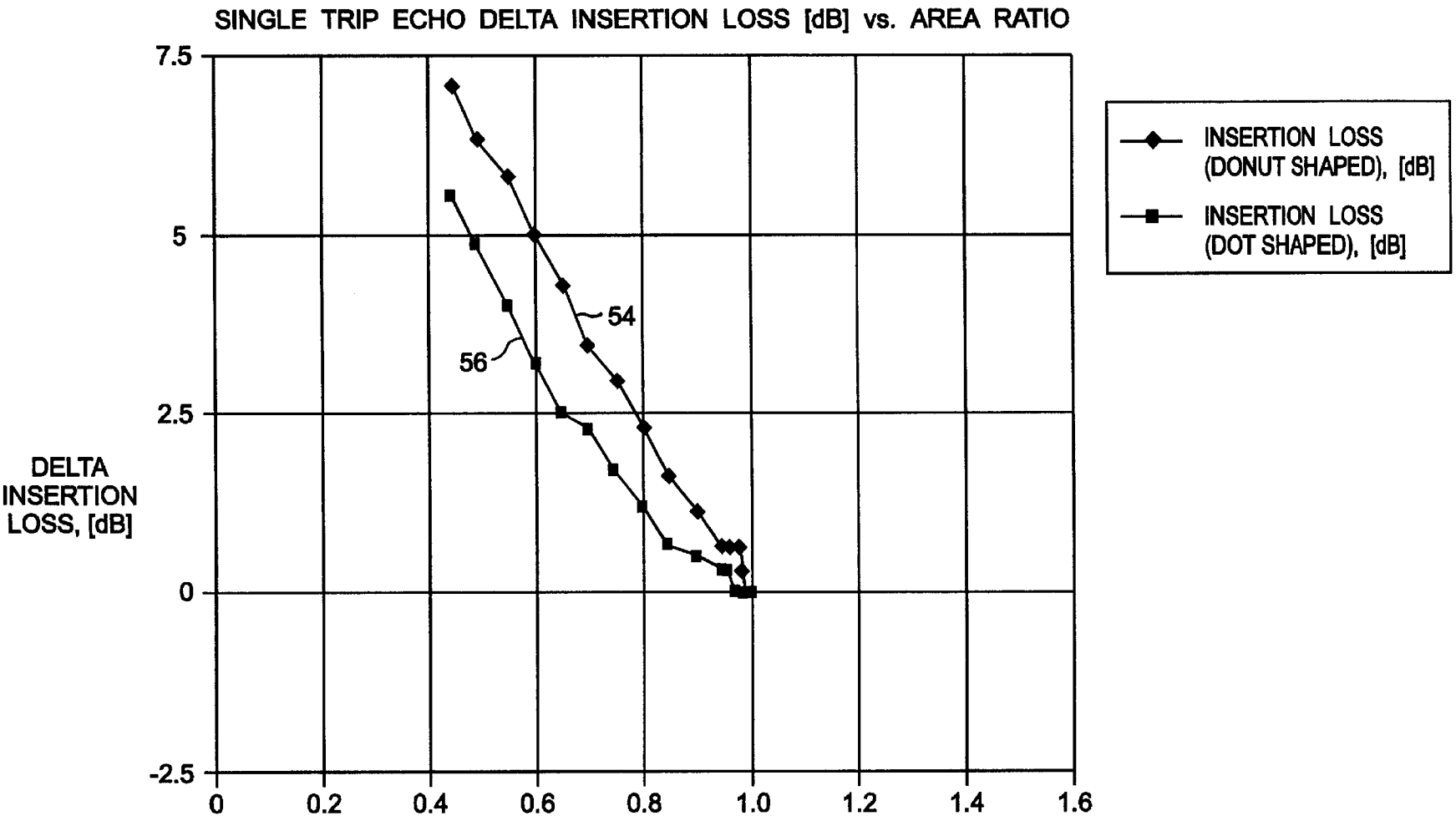
FIG. 8C represents a normalized single trip echo insertion loss versus area ratio for a "donut" and "dot" upper electrode.

FIG. 8B normalizes the round-trip echo insertion loss versus area ratio chart of FIG. 8A. In particular the dB loss is set at zero when the area ratio is equal to one. This graph is then translated into the graph of FIG. 8C which is a normalized single trip echo insertion loss versus area ratio. The information found herein is useful in the selection of appropriate detuning for specific end-to-end test print patterns. Particularly, referring back to FIG. 4, it was shown that at 6.0 dB the central area of the test pattern print had a desired level of intensity, however, the edges were insufficiently covered. It was further considered that at 3.5 dB, while the center portion of the test pattern was overly marked, i.e. too high an intensity, the outer edges were appropriately marked.

Using the foregoing information it can be determined that there is a range of 2.5 dB in which proper marking would occur from edge to edge including the center portion. This is then used in conjunction with information from FIG. 8C, which shows that when the area ratio is equal to 1.0 there is no detuning taking effect, and no insertion losses due to the removal of area of one of the upper electrodes 18. Therefore, by providing the area ratio 1.0 as the outer edge upper values in an emitter row of a print head, and understanding that there is a 2.5 dB range where the emitters operate in a desirable manner, it can be determined that the desirable area ratio for the upper electrodes associated with the center emitters would be an area ratio of approximately 0.75 (for a "donut" shaped transducer), for a print head which applies ink in accordance with the test prints of FIG. 3.

Using the above information a range of detuned upper electrodes extending from the center columns, having the highest detuning, to the outer edges of a row of electrodes such as in array 32 may be formed, allowing for a uniform print output without a "frown" effect. Those emitters which are more efficient are detuned thereby decreasing their efficiency and bringing them into operational conformity with emitters on the outer edges of a row. While it has been shown that the range in this particular embodiment is from a 1.0 area ratio to one of a 0.75 area ratio, other area ratios may be determined to be useful for a print head.

Also, the inventors have determined transducer device capacitance (particularly 0.5pF for 600dpi print head) is also reduced due to the detuning. Edge capacitance may also increase due to an increase in device periphery.

A balanced symmetrical area reduction of the upper electrodes is preferred as to avoid unnecessary transducer misdirectionality. Thus it is desirable to remove symmetric portions of the upper electrode in a manner which maintains a symmetric shape, one way to accomplish this is through the use of a laser with a round aperture.

This invention presents a manner of achieving better print uniformity using AIP print heads. It addresses the typical print head end-to-end fixed pattern "frown" effect that has been observed in AIP print heads. The present approach involves a process of fixed pattern correction in addition to the normal print head process and assembly process. Particularly, after an initial print test or threshold of ejection measurement from end to end, a transducer threshold of ejection end-to-end profile is captured. This can be accomplished visually, by viewing prints made by emitters at a single given power condition. It is also possible to obtain this end profile by investigating each individual emitter's threshold of ejection.

In one embodiment of the present invention, a first step of correction employs a laser trimming of the upper electrode to detune the transducers by a predetermined amount. Those transducers that emit strongly, such as near center columns, will be detuned by a greater amount than those at the end of the row. By selective laser trimming of the top electrode's area, a transducer's print efficiency is effectively reduced. Subsequent print tests after laser trimming then confirms any print uniformity improvement.

The transducer detuning profile is then established by performing this operation across representative print heads. A second step is then undertaken to encode the area and shape changes necessary for a first order correction into a row electrode process mask. Particularly, it is envisioned the present invention can be incorporated into print heads made under a lithographic process. As disclosed, for example, in the patent to Hadimioglu et al. U.S. Pat. No. 5,565,113, hereby incorporated by reference. A third step of correction includes a further refining step after the incorporation of the first order correction in the row electrode mask.

Incorporation of the first order correction in the mask will require adjusting a single mask structure in the process. Once a proper transducer array structure has been determined and coded into the transducer array mask, it can be used in the manufacture of multiple acoustic droplet emitter print heads.

Since the upper electrodes of the transducer are connected together to form a common row electrode, reducing the upper electrode's effective area may impact row electrode RF current carrying capability. The foregoing may therefore provide a limit as to how much upper electrode area can be removed without limiting the row electrode's effectiveness. A manner of overcoming this problem is by a process adjustment to the upper electrode thickness to improve conductivity. The adjustment of the location of the RF feed along with the row can also be made to further improve RF current carrying capability.

In addition to using laser trimming in order to obtain a desired pattern, there is also the concept of using laser trimming without incorporation in the masks as well as undertaking correction by simulation using a computer, and thereafter encoding the corrected transducer array directly into the mask structure.

From the preceding, numerous modifications and variations of the principles of the present invention will be obvious to those skilled in its art. Therefore, all equivalent relations to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described and accordingly, all suitable modifications and equivalents may be resorted to falling within the scope of the invention.

In consideration thereof, I claim:

1. An acoustic droplet emitter for emitting droplets of liquid from a surface of a body of liquid, said emitter comprising:

a plurality of planar acoustic wave transducers located below said body of liquid, each transducer of said plurality designed to include a piezo-electric device held between a lower electrode and an upper electrode, the plurality of transducers arranged in an array of rows and columns, upper electrodes of a same row having different sized areas, wherein efficiency of each of the transducers is dependent upon the area of the upper electrode;

drive means coupled to said lower and upper electrodes of said transducers, for energizing said transducers to launch cones of acoustic waves into said liquid at an angle selected to cause said acoustic waves to come to a focus at the surface of said body of liquid, whereby said focused acoustic waves impinge upon and acoustically excite liquid near the surface of said body of liquid to an elevated energy level within a limited area thereby enabling liquid droplets of predetermined diameter to be propelled from said body of liquid on demand.

2. The acoustic droplet emitter according to claim 1 wherein upper electrodes of a same row having different sized areas are configured such that the upper electrodes closest to a center of the row have less area than the upper electrodes located at ends of the row.

3. The acoustic droplet emitter according to claim 2 wherein the upper electrodes closest to the center of the row have approximately 75% of the area of the upper electrodes located at the ends of the row.

4. The acoustic droplet emitter according to claim 1 wherein selected ones of the upper electrodes have one of a donut shape and a dot shape.

5. The acoustic droplet emitter according to claim 4 wherein the donut shaped and dot shaped upper electrodes are symmetrical.

6. The acoustic droplet emitter according to claim 4 wherein the donut shaped and dot shaped upper electrodes are laser trimmed electrodes.

7. The acoustic droplet emitter according to claim 1 being a lithographically manufactured device, wherein the array of upper electrodes is configured from an electrode mask structure.

8. A printer comprising:

means for producing a first electrical input;

a plurality of individual droplet emitters, each of said plurality of individual droplet emitters having a transducer for converting said first electrical input into acoustic energy in response to an applied control signal, each of said transducers including a piezo-electric material arranged between a lower electrode and an upper electrode;

array forming means for interconnecting said plurality of droplet emitters into an array of rows and columns of droplet emitters such that said first electrical input can be applied to said transducer of each of said droplet emitters in a row, and such that a control signal can be applied to each of said droplet emitters in a column, at least some of the upper electrodes associated with the row of transducers having different predetermined areas, wherein efficiency of each of the transducers is dependent upon the area of the upper electrode;

row select means for applying said first electrical input to a selected row of said array;

control signal means for producing a set of column dependent control signals for a selected column; and column select means for applying a column dependent control signal to the droplet emitters of said selected column.

9. The acoustic droplet emitter according to claim 8 wherein upper electrodes of a same row having different sized areas are configured such that the upper electrodes closest to a center of the row have less area than the upper electrodes located at ends of the row.

10. The acoustic droplet emitter according to claim 9 wherein the upper electrodes closest to the center of the row have approximately 75% of the area of the upper electrodes located at the ends of the row.

11. The acoustic droplet emitter according to claim 9 wherein selected ones of the upper electrodes have one of a donut shape and a dot shape.

12. The acoustic droplet emitter according to claim 11 wherein the donut shaped and dot shaped upper electrodes are symmetrical.

13. A method for improving end-to-end print uniformity of an array of droplet emitters which emit droplets in response to electrical inputs selectively applied to an array of transducers of the droplet emitters, the transducers arranged in an array of columns and rows, the method comprising the steps of:

at least one of (I) printing a test pattern on a destination document to determine uniformity of printing and (ii)

measuring threshold values applied to individual transducers which will cause a droplet to be emitted from a corresponding droplet emitter;

obtaining a transducer array end-to-end threshold of emitting profile based on at least one of (I) and (ii) above; and detuning those transducers determined to be overly efficient based on the obtained end-to-end threshold of emitting profile, such that the uniformity of emitting across the droplet emitter array is increased.

14. The method according to claim 13 wherein the step of detuning includes laser trimming of a top electrode of selected transducers of the transducer array.

15. The method according to claim 13 further comprising the steps of:

repeating the step of at least one of (I) printing a test pattern and (ii) measuring threshold values of individual transducers to confirm an increase in the uniformity in printing of the droplet emitter array; and encoding area shape changes made to the top electrodes into a row top electrode mask, to be used in a lithographic construction process of the droplet emitter array.

16. The method according to claim 13 further including:

encoding area shape changes made to the top electrodes into a row top electrode mask, to be used in a lithographic construction process of the droplet emitter array.

17. The method according to claim 13 wherein the step of detuning includes altering a row top electrode mask structure used in a lithographic construction process of the transducer array.

18. The method according to claim 13 wherein the step of detuning includes at least one of, (I) laser trimming of a row top electrode of selected transducers of the array, and (ii) altering a row top electrode mask structure used in a lithographic construction process of the transducer array, wherein the detuning is accomplished by balanced symmetrical area reduction of the top electrode.

19. The method according to claim 13 wherein the top electrodes of the transducers closer to the center columns of the transducer array are detuned more than the top electrodes of the transducers further from the center columns.

20. The method according to claim 19 wherein the top electrodes of the transducers nearest the center columns have approximately 75% the area as the top electrodes of the transducers farthest from the center columns.

* * * * *